US009804558B2

(12) United States Patent
Takemoto

(10) Patent No.: US 9,804,558 B2
(45) Date of Patent: Oct. 31, 2017

(54) CONNECTOR ATTACHING/DETACHING STRUCTURE, FUSER ASSEMBLY, AND IMAGE FORMING APPARATUS

(71) Applicant: KYOCERA Document Solutions Inc., Osaka-shi, Osaka (JP)

(72) Inventor: Mitsutoshi Takemoto, Osaka (JP)

(73) Assignee: KYOCERA DOCUMENT SOLUTIONS INC., Osaka-Shi, Osaka (JP)

( * ) Notice: Subject to any disclaimer, the term of this patent is extended or adjusted under 35 U.S.C. 154(b) by 0 days.

(21) Appl. No.: 15/191,585

(22) Filed: Jun. 24, 2016

(65) Prior Publication Data

US 2016/0378055 A1 Dec. 29, 2016

(30) Foreign Application Priority Data

Jun. 29, 2015 (JP) ..... 2015-130304
Apr. 6, 2016 (JP) ..... 2016-076626

(51) Int. Cl.
*G03G 15/00* (2006.01)
*G03G 21/16* (2006.01)
*H01R 13/73* (2006.01)

(52) U.S. Cl.
CPC ..... *G03G 21/1652* (2013.01); *G03G 21/1685* (2013.01); *H01R 13/73* (2013.01)

(58) Field of Classification Search
USPC .... 399/75, 90, 122, 328, 329; 219/216, 619; 439/131, 376
See application file for complete search history.

(56) References Cited

U.S. PATENT DOCUMENTS 4,929,183 A * 5/1990 Rinneburger ..... H01R 12/777 439/131
5,481,350 A * 1/1996 Yasui ..... G03G 15/2039 219/216
6,270,371 B1 * 8/2001 Doushita ..... H01R 13/6315 439/376
2013/0122741 A1 5/2013 Imoto et al.
2015/0071676 A1 3/2015 Imoto et al.

FOREIGN PATENT DOCUMENTS

JP H09196738 A 7/1997
JP 2005300796 A 10/2005
JP 2013105938 A 5/2013

* cited by examiner

*Primary Examiner* — Hoan Tran

(57) ABSTRACT

A connector attaching/detaching structure detachably holds a connector in a housing. The connector attaching/detaching structure includes a first cable, a second cable, a terminal, a connector, and a housing. The terminal is provided on an end of the first cable. The connector is provided on an end of the second cable. The connector can establish an electrical connection with the terminal by inserting the terminal into the connector. The housing is provided with a connector holding portion that detachably holds the connector. A wall section, which forms an outer part of the connector holding portion, has a cutout wide enough to permit the first cable to pass therethrough.

9 Claims, 7 Drawing Sheets

CONNECTOR ATTACHING/DETACHING STRUCTURE, FUSER ASSEMBLY, AND IMAGE FORMING APPARATUS

INCORPORATION BY REFERENCE

The disclosures of Japanese Patent Applications No. 2015-130304 filed on Jun. 29, 2015 and No. 2016-76626 filed on Apr. 6, 2016 each including the specification, drawings and abstract are incorporated herein by reference in their entirety.

BACKGROUND

This present disclosure relates to a connector attaching/detaching structure, a fuser assembly, and an image forming apparatus.

In an image forming apparatus, typified by multifunction peripherals, light is emitted to a photoreceptor in an image forming unit based on image data to form an electrostatic latent image on the photoreceptor. After the formed electrostatic latent image is made visible by applying charged toner, the visible image is transferred onto a sheet of paper and is fixed onto the sheet by a fuser assembly in the image forming apparatus, and then the paper with the toner fixed thereon is ejected out of the image forming apparatus. The fuser assembly includes cables and connectors used to apply power to a heater for application of heat. Various sensors are also attached to the fuser assembly.

There are conventionally known technologies relating to sensors including cables and image forming apparatuses with cables.

A typical photosensor includes a light-emitting element and a light-receiving element that are opposed to each other across a path for an object to be sensed, and a light-transmittable case that is formed so as to cover the light-emitting element and light-receiving element, but to expose an optical path extending from the light-emitting element to the light-receiving element to the outside. The case has antistatic effects at least on surface areas through which the optical path from the light-emitting element to the light-receiving element passes.

A typical image forming apparatus includes a main body with an image forming unit built therein and a openable/closable document feeding device that is provided on an upper face of the main body and used to supply original documents. The document feeding device is attached to the main body so as to rotate to open and close about a pivot provided on one side of the upper face of the main body, and includes a cord installed near the pivot to electrically connect the document feeding device and the main body. The cord is covered with an exterior member that is detachably attached to the main body.

A typical electric cable connecting device includes a first apparatus and a second apparatus mounted on the first apparatus. An electric cable drawn from the second apparatus has a cable-side connector at an end, and the cable-side connector is detachably connected to a board-side connector provided to a circuit board of the first apparatus. In the electric cable connecting device, the housing of the first apparatus has an opening formed to face the board-side connector. A lid for sealing the opening is attached to an end part of the electric cable with an attachment member. The lid is detachably attached to the opening with a securing member while the cable-side connector is connected to the board-side connector.

SUMMARY

One aspect of the present disclosure is directed to a connector attaching/detaching structure that detachably holds a connector in a housing. The connector attaching/detaching structure includes a first cable, a second cable, a terminal, a connector, and a housing. The terminal is provided on an end of the first cable. The connector is provided on an end of the second cable. The connector can establish an electrical connection with the terminal by inserting the terminal into the connector. The housing has a connector holding portion that detachably holds the connector. A wall section, which forms an outer part of the connector holding portion, has a cutout wide enough to permit the first cable to pass therethrough.

Another aspect of the present disclosure is directed to a fuser assembly that fixes toner on paper. The fuser assembly includes a pressure roller, a heat roller, a thermistor, a first cable, a second cable, a terminal, a connector, and a housing. The heat roller is disposed in contact with the pressure roller. The pressure roller is disposed to face the surface of the heat roller. The thermistor senses the temperature of the heat roller. The first cable is connected to the thermistor. The second cable is connected to a control unit that controls the fuser assembly. The terminal is provided on an end of the first cable. The connector is provided on an end of the second cable. The connector can establish an electrical connection with the terminal by inserting the terminal into the connector. The housing has a connector holding portion that detachably holds the connector. The housing accommodates the heat roller and pressure roller. A wall section, which forms an outer part of the connector holding portion, has a cutout wide enough to permit the first cable to pass therethrough.

Yet another aspect of the present disclosure is directed to an image forming apparatus that includes a fuser assembly fixing a visible toner image on paper and an image forming unit forming the visible toner image on the paper. The fuser assembly includes a pressure roller, a heat roller, a thermistor, a first cable, a second cable, a terminal, a connector, and a housing. The heat roller is disposed in contact with the pressure roller. The pressure roller is disposed to face the surface of the heat roller. The thermistor senses the temperature of the heat roller. The first cable is connected to the thermistor. The second cable is connected to a control unit that controls the fuser assembly. The terminal is provided on an end of the first cable. The connector is provided on an end of the second cable. The connector can establish an electrical connection with the terminal by inserting the terminal into the connector. The housing has a connector holding portion that detachably holds the connector. The housing accommodates the heat roller and pressure roller. A wall section, which forms an outer part of the connector holding portion, has a cutout wide enough to permit the first cable to pass therethrough.

DETAILED DESCRIPTION

Figure 1:
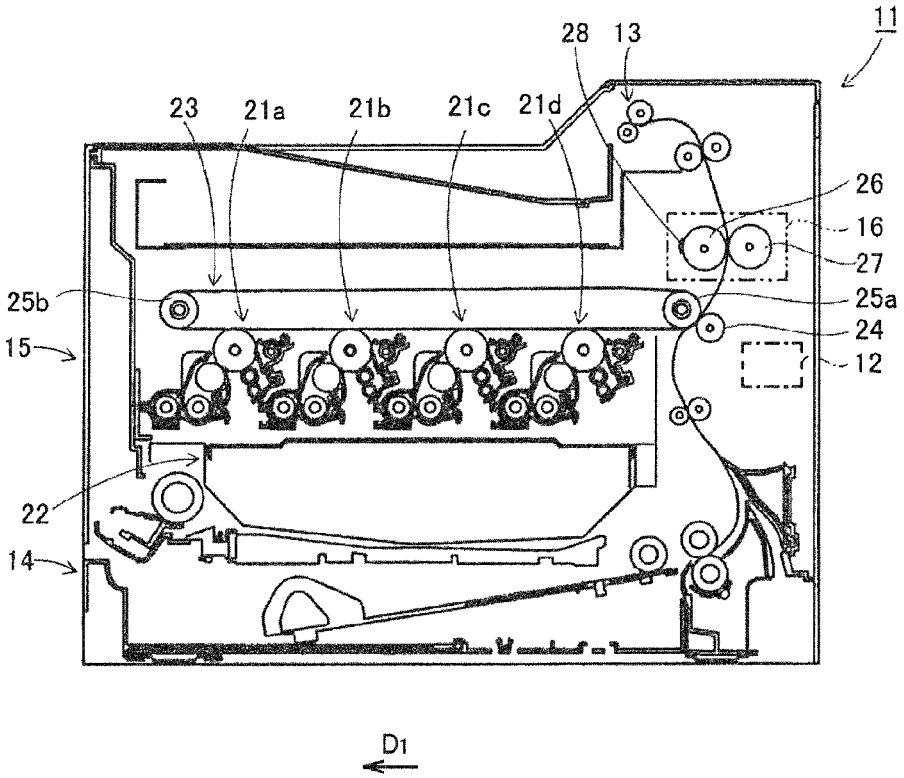
FIG. 1 is a cross-sectional view of a printer to which an image forming apparatus equipped with a fuser assembly with a connector attaching/detaching structure according to an embodiment of the present disclosure is applied.

An embodiment of the present disclosure will be described below. FIG. 1 is a cross-sectional view of a printer 11 to which an image forming apparatus equipped with a fuser assembly with a connector attaching/detaching structure according to an embodiment of the present disclosure is applied. An arrow D1 in FIG. 1 indicates a direction from the rear to the front.

Referring to FIG. 1, the printer 11 includes a control unit 12, an operation unit (not shown), a paper feed cassette 14, an image forming unit 15, a discharge unit 13, and a fuser assembly 16. The control unit 12 is schematically shown by a dot-and-dash line.

The control unit 12 controls the entire printer 11. The operation unit displays information submitted from the printer 11 and entries made by users, and is also used to turn on or off the power source. The paper feed cassette 14 accommodates multiple sheets of paper which are to be supplied to the image forming unit 15. In FIG. 1, the fuser assembly 16 is outlined by a dashed double-dotted line for schematic representation.

Next, a description will be made about the configuration of the aforementioned image forming unit 15. The image forming unit 15 includes four imaging units 21*a*, 21*b*, 21*c*, 21*d* provided for four colors respectively: yellow, magenta, cyan, and black, a laser scanner unit (LSU) 22, a transfer belt 23 serving as an intermediate transfer unit, and a secondary transfer roller 24. The LSU 22 exposes the four imaging units 21*a* to 21*d* separately with light based on image data received through a network (not shown). Toner images formed by imaging units 21*a* to 21*d* are primarily-transferred onto the transfer belt 23 before they are transferred onto a sheet of paper. More specifically, the transfer belt 23 has no end, and is unidirectionally rotated by a pair of a driving roller 25*a* and a driven roller 25*b* to receive the toner images formed by the yellow, magenta, cyan, and black imaging units 21*a* to 21*d*. The toner images primarily-transferred on the transfer belt 23 are then transferred onto a sheet of paper transported by the secondary transfer roller 24. Subsequently, the paper with the toner images transferred thereon passes through the fuser assembly 16 that fixes the toner on the paper, and is then ejected to the discharge unit 13.

Figure 2:
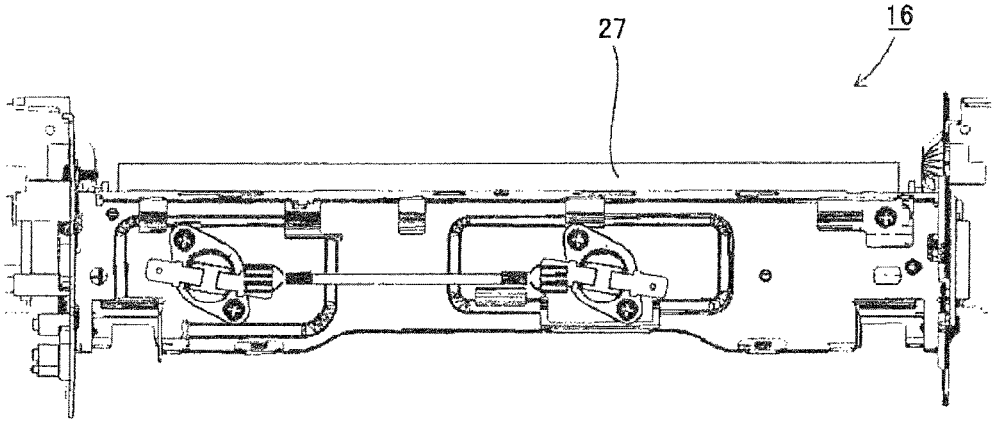
FIG. 2 shows the fuser assembly viewed along the direction from the front to the rear, which is the opposite direction to an arrow D1 in FIG. 1.
Figure 3:
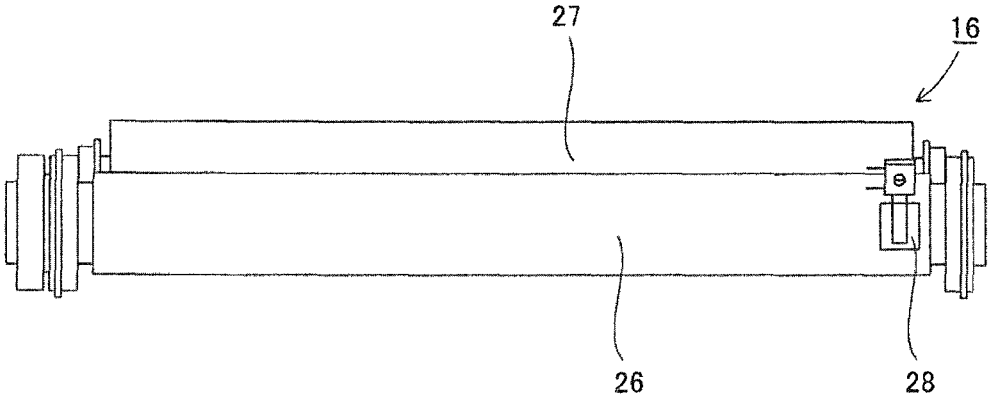
FIG. 3 shows the fuser assembly in FIG. 2 in a state where a housing, which will be described later, is removed.
Figure 4:
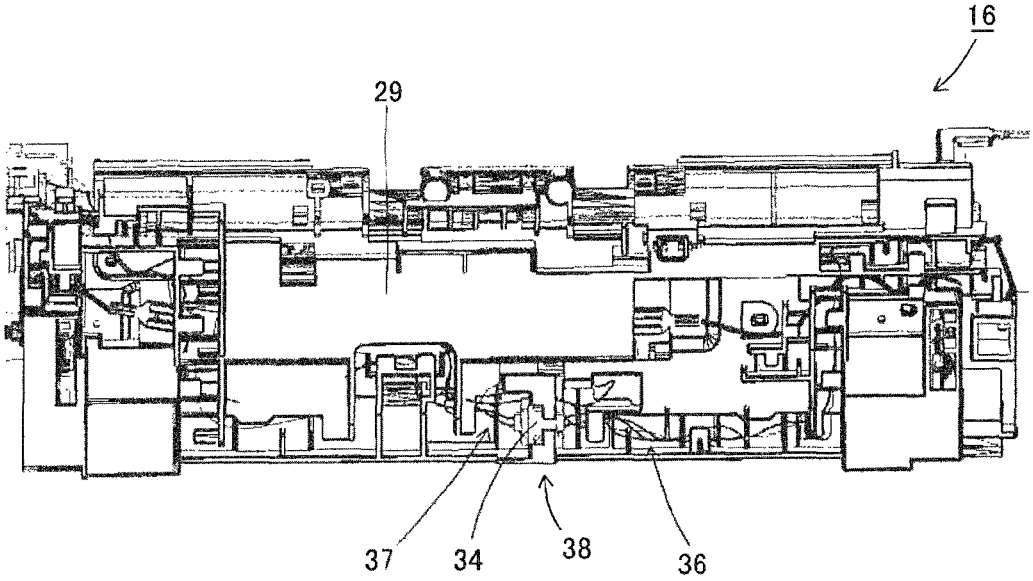
FIG. 4 shows the housing of the fuser assembly viewed along the opposite direction to that indicated by the arrow D1 in FIG. 1.

Next, the configuration of the fuser assembly 16 will be described. FIG. 2 shows the fuser assembly 16 viewed along the direction from the front to the rear, which is the opposite direction to the arrow D1 in FIG. 1. FIG. 3 shows the fuser assembly 16 in a state where a housing, which will be described later, is removed. FIG. 4 shows the housing of the fuser assembly 16 viewed along the opposite direction to the direction indicated by the arrow D1 in FIG. 1.

Referring to FIGS. 1 to 4, the fuser assembly 16 includes a heat roller 26, a pressure roller 27, a thermistor 28, and a housing 29. The heat roller 26 is hollow and rotatable, and applies heat to paper to fuse toner on the paper. The pressure roller 27 is solid and rotatable in a direction opposite to that of the heat roller 26. The heat roller 26 and pressure roller 27 apply pressure to paper while the paper is being transported between the heat roller 26 and pressure roller 27. The thermistor 28 senses the temperature of the heat roller 26. The housing 29 forms the outer shape of the fuser assembly 16 and accommodates the heat roller 26 and pressure roller 27. The housing 29 is an integrally formed housing made of resin.

The heat roller 26 is in the shape of a cylinder and is made from an unprocessed metal pipe. A heating means, such as a heater, is provided inside the heat roller 26, but it is not shown. Application of electric power to the heater heats up the heat roller 26 to a predetermined temperature appropriate for fusing. The thermistor 28 is a device that changes the electric resistance according to the surface temperature of the heat roller 26. The thermistor 28 is disposed so as to make contact with the surface of the heat roller 26. More specifically, the thermistor 28 is placed at a position on the surface of the heat roller 26 which does not make contact with the transported paper, and touches the surface near one end of the heat roller 26. The control unit 12 detects the surface temperature of the heat roller 26 from the changes in the resistance value of the thermistor 28. The surface temperature of the heat roller 26 is controlled based on the detection result.

The pressure roller 27 is a rubber-like cylindrical member with elasticity. The heat roller 26 and pressure roller 27 abut against each other. Specifically, the pressure roller 27 presses against the heat roller 26 so that the surface of the heat roller 26 makes contact with the surface of the pressure roller 27. Heat propagation from the heat roller 26 to the pressure roller 27 is achieved through contact between the heat roller 26 and pressure roller 27. Thus, the heat roller 26 and pressure roller 27 are maintained at almost the same temperature.

Figure 5:
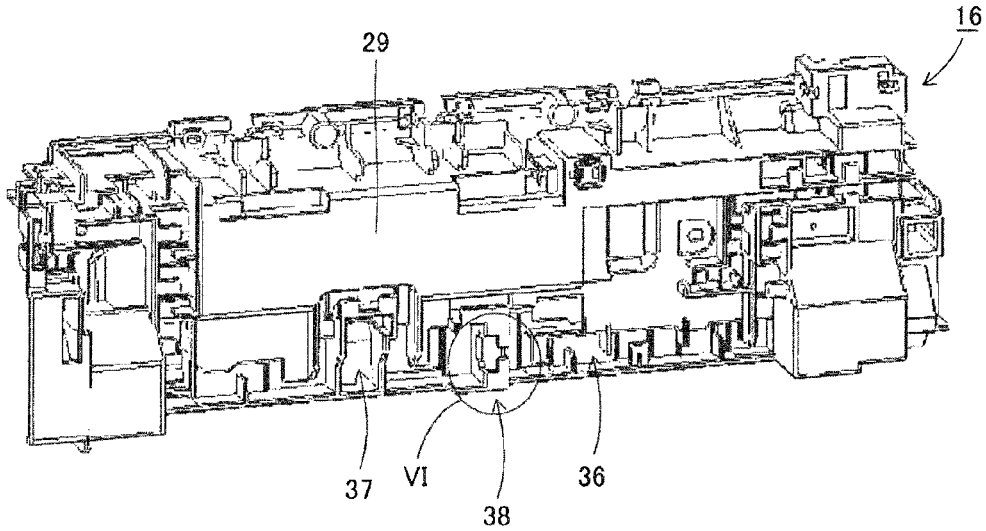
FIG. 5 is a perspective view showing the appearance of the housing included in the fuser assembly.
Figure 6:
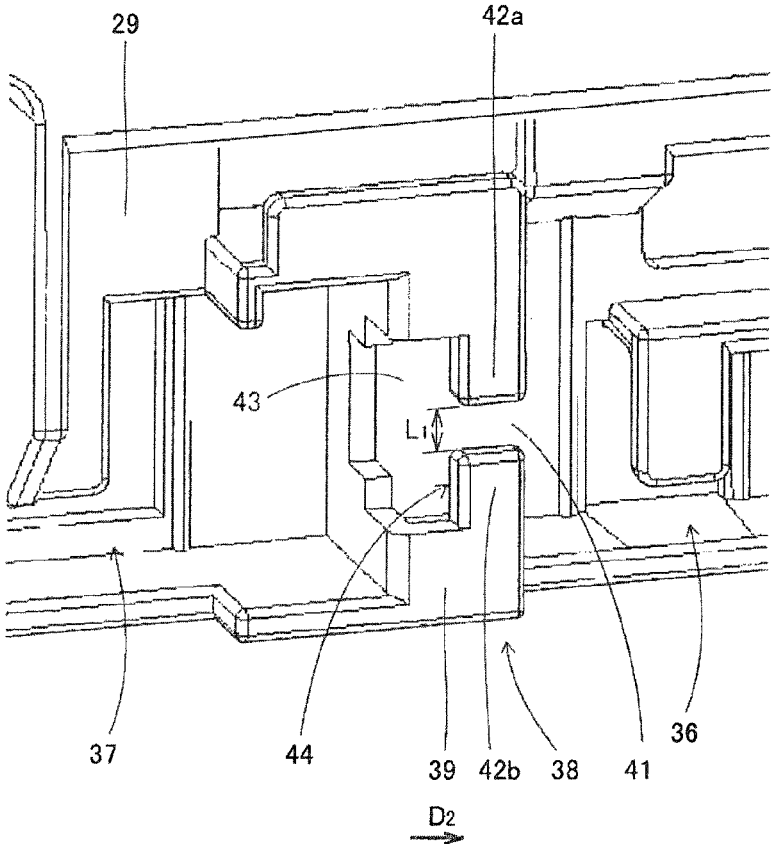
FIG. 6 is an enlarged view of an area indicated by VI in FIG. 5.
Figure 7:
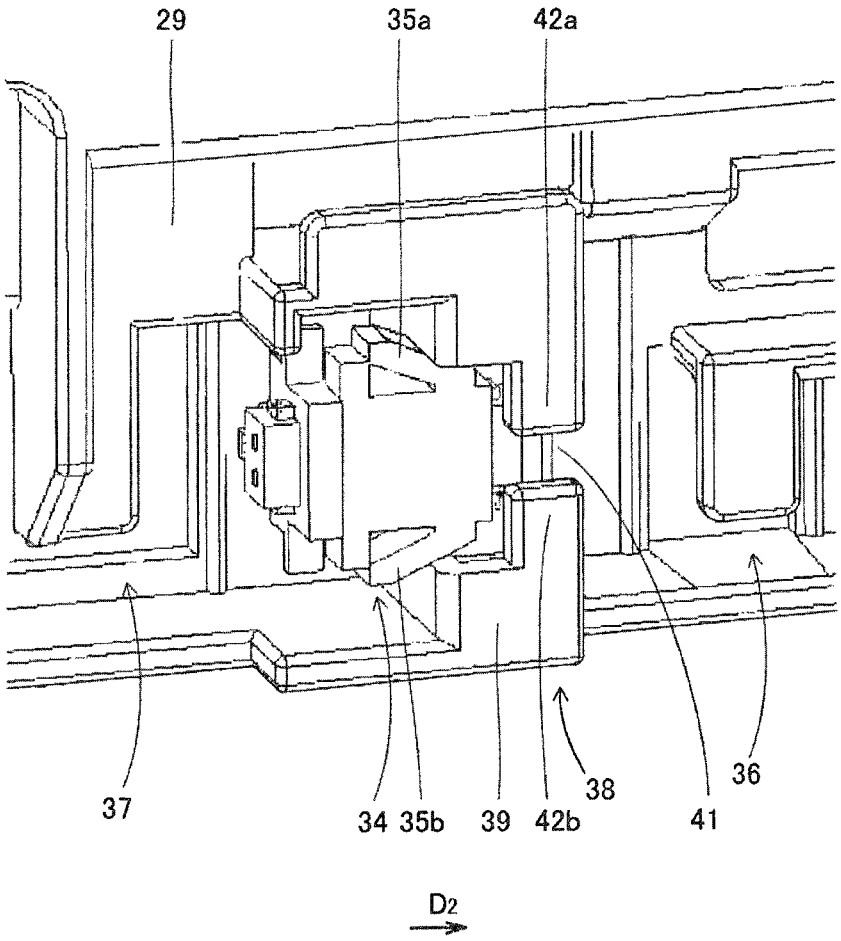
FIG. 7 shows a state before attaching a connector in the area shown in FIG. 6.
Figure 8:
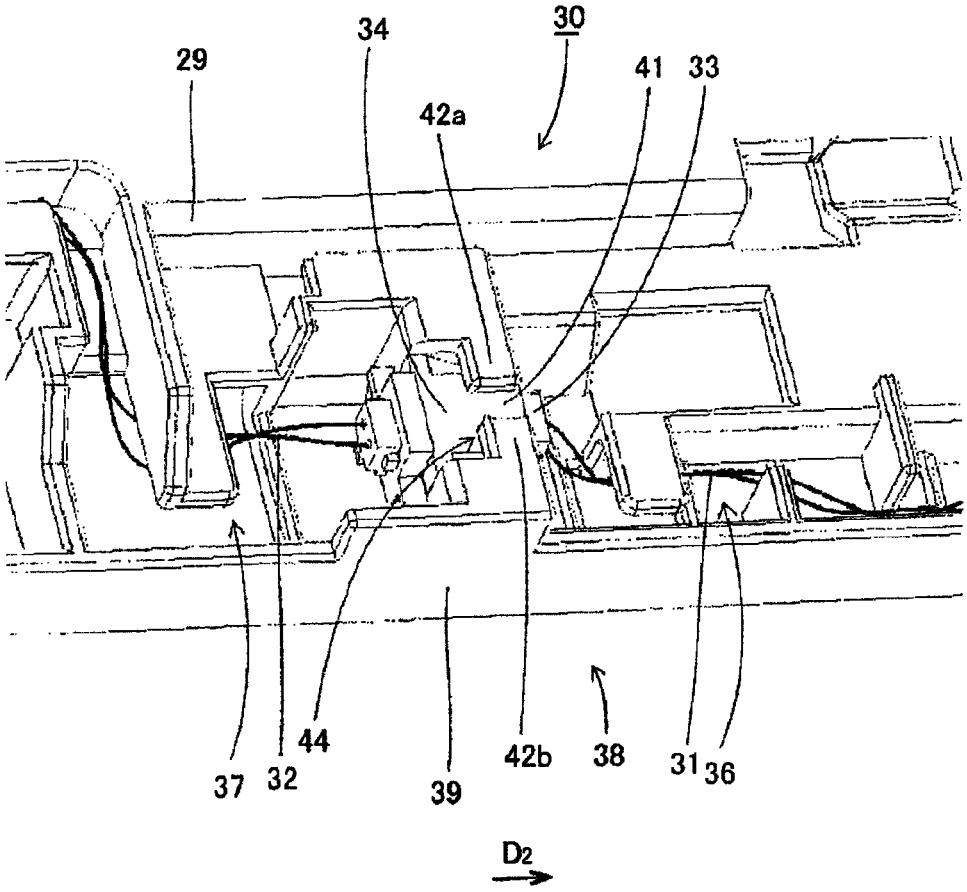
FIG. 8 shows a state where the connector is attached.

Next, a specific configuration of the connector attaching/detaching structure 30 in the fuser assembly 16 will be described. FIG. 5 is a perspective view showing the appearance of the housing 29 included in the fuser assembly 16. FIG. 6 is an enlarged view of an area indicated by VI in FIG. 5. FIG. 7 illustrates a state before attaching the connector 34 in the area shown in FIG. 6. FIG. 8 illustrates a state where the connector 34 is attached.

Referring to FIGS. 1 to 8, the fuser assembly 16 includes the connector attaching/detaching structure 30 that detachably holds the connector 34 in the housing 29. The connector attaching/detaching structure 30 includes the housing 29, a first cable 31, a second cable 32, a terminal 33, and the connector 34. The terminal 33 is provided on one end of the first cable 31. The other end of the first cable 31 is connected to the thermistor 28. The connector 34 has a pair of elastically-deformable snap parts 35*a*, 35*b*. The connector 34 is provided on one end of the second cable 32. The connector 34 has a port (not shown) into which the terminal 33 is inserted to couple the connector 34 to the terminal 33, thereby being able to establish an electrical connection between the connector 34 and the terminal 33. The other end of the second cable 32 is connected to the control unit 12 via a circuit board or the like (not shown).

The housing 29 has a recessed portion 36 that can accommodate the first cable 31. The housing 29 also has a recessed portion 37 that can accommodate the second cable 32. Both the recessed portions 36, 37 are formed in the housing 29 so as to recess from the outside to the inside. The first cable 31 and second cable 32 are accommodated in the housing 29 as if they are laid along in the recessed portions 36, 37, respectively, in the housing 29.

The housing 29 has a connector holding portion 38 that detachably holds the connector 34. The connector holding portion 38 is formed by cutting away part of the housing 29, which is sometimes called "panel cutting". The connector holding portion 38 is formed between the recessed portion 36 and recessed portion 37. The connector holding portion 38 is composed of a plurality of wall sections 39 which are part of the housing 29. The connector 34 is held in an interior part of the connector holding portion 38 composed of the wall sections 39.

The connector 34 is detachably held in the connector holding portion 38 by snap fitting. Specifically, while the pair of snap parts 35*a*, 35*b* are bent toward the center as if they are folded, the connector 34 is inserted into the connector holding portion 38 in the direction indicated by an arrow D2 in FIG. 7 to fit therein, and thereby mounted. Then, the connector 34 is snap-fitted in the connector holding portion 38 by means of restoration force of the snap parts 35*a*, 35*b*. On the contrary, the connector 34 can be detached from the connector holding portion 38 by bending the snap parts 35*a*, 35*b* as if folding them, and applying a force to pull out the connector 34 in the opposite direction to the arrow D2 in FIG. 7.

A wall section 39 that forms an outer part of the connector holding portion 38 has a cutout 41 wide enough to permit the first cable 31 to pass therethrough. The wall section 39 includes a pair of projecting parts 42*a*, 42*b* projecting toward each other and providing the cutout 41 between them. The width of the cutout 41, which is indicated by a length L1 in FIG. 6, between leading edges of the projecting parts 42*a* and 42*b* is designed to be wider than the width of the first cable 31. If, for example, the first cable 31 extending from the terminal 33 is composed of a plurality of cable lines, the length L1 is preferably set to be wide enough for the cable lines to pass between the pair of projecting parts 42*a*, 42*b*. In the connector holding portion 38, there is a space 44 that is surrounded by a bottom wall 43, which is a part of the wall sections 39, and the projecting parts 42*a*, 42*b* so as to accommodate a part of the connector 34. The space 44 has a height that is approximately the same as that of the connector 34, thereby, suppression of movement of the connector 34 from the connector holding portion 38 in vertical directions is more enhanced.

Figure 9:
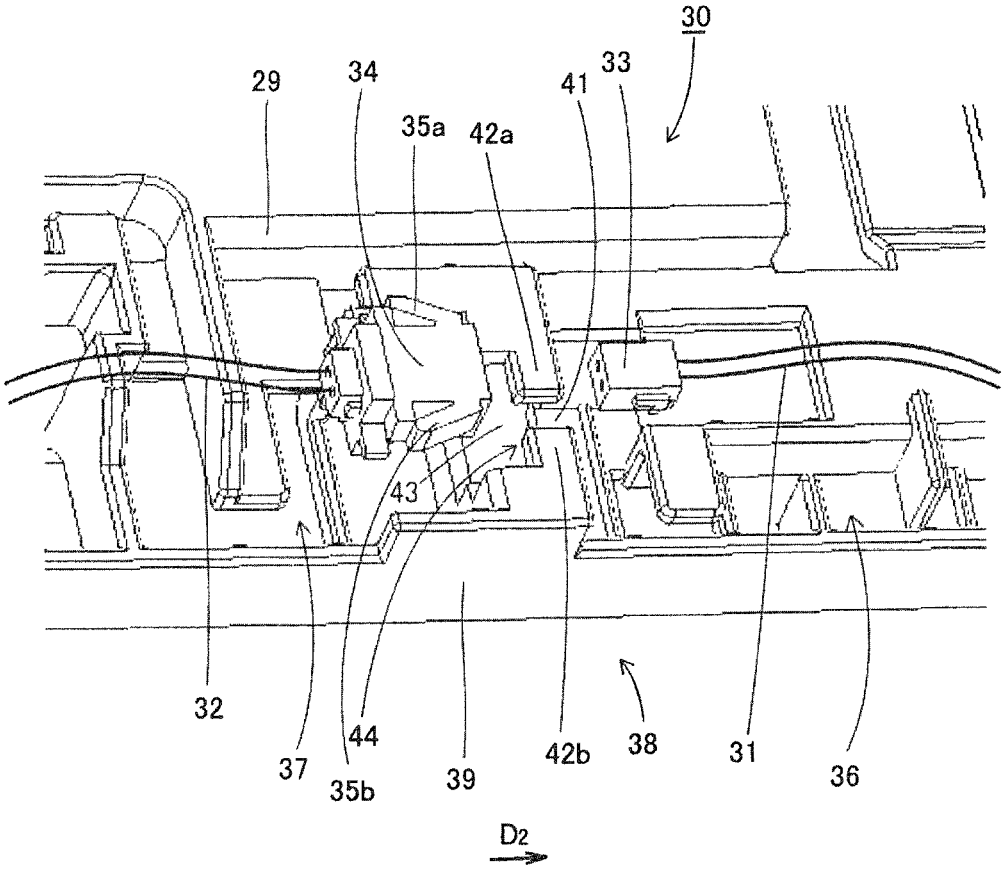
FIG. 9 shows a state before connecting a terminal to the connector.
Figure 10:
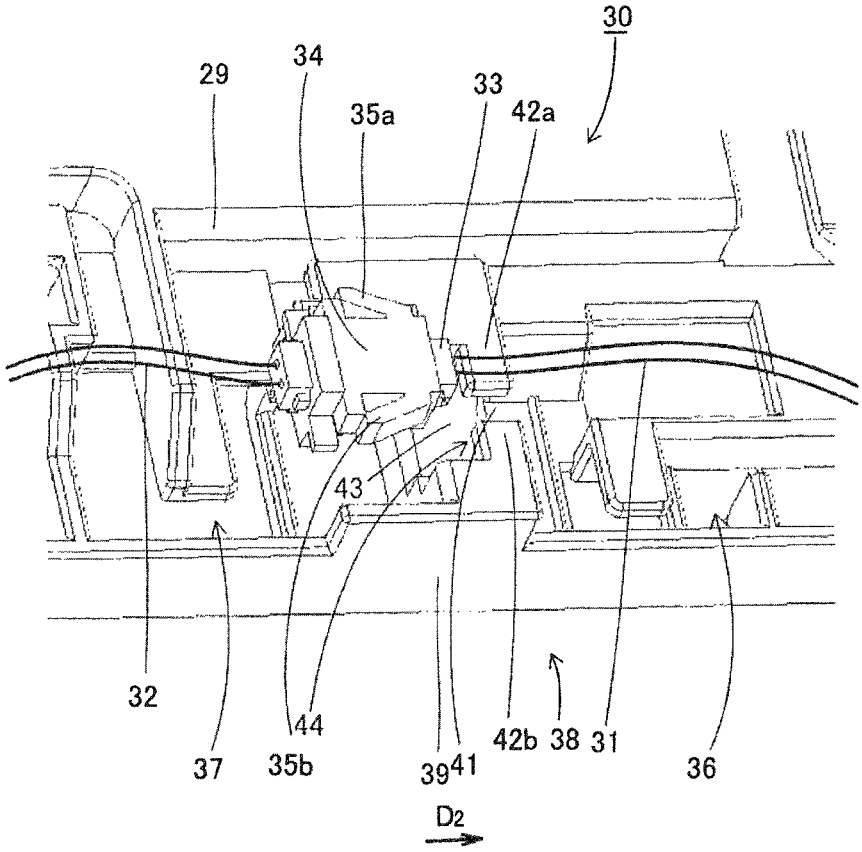
FIG. 10 shows a state after connecting the terminal to the connector, and before connecting the connector to a connector holding portion.

Next, a method for attaching the connector 34 to the connector holding portion 38 will be described. FIG. 9 shows a state before connecting the terminal 33 to the connector 34. FIG. 10 shows a state after connecting the terminal 33 to the connector 34, and before attaching the connector 34 to the connector holding portion 38. Each of FIGS. 9 and 10 corresponds to the perspective view shown in FIG. 8.

Referring to FIG. 9, the terminal 33 is firstly coupled to the connector 34. Coupling of the terminal 33 and connector 34 is made above the cutout 41 formed in the connector holding portion 38. Since there are almost no physical obstacles, such as the wall section 39, around the connector 34 and terminal 33, coupling the terminal 33 to the connector 34 can be achieved relatively easily. FIG. 10 shows the terminal 33 and connector 34 in a coupled state.

The connector 34 in this state is held in the connector holding portion 38. Specifically, the first cable 31 extending from the terminal 33 is drawn through the cutout 41, in other words, between the projecting parts 42*a*, 42*b*. Then, the connector 34 with both the snap parts 35*a*, 35*b* folded is inserted into the connector holding portion 38 in the direction indicated by the arrow D2 so as to be held by the connector holding portion 38.

According to the connector attaching/detaching structure 30, the connector holding portion 38 formed in the housing 29 has the cutout 41, which is wide enough to permit the first cable 31 to pass therethrough, in the wall section 39 that forms an outer part of the connector holding portion 38, and therefore the connector 34 with the terminal 33 connected thereto can be easily attached in the connector holding portion 38. This circumvents the need to connect the terminal 33 to the connector 34 that has been attached in the connector holding portion 38. Thus, the connector attaching/detaching structure 30 can improve convenience for users at the time of maintenance.

In addition, the fuser assembly 16 configured as above offers good maintainability. Specifically, there is no need to suitably locate the connector holding portion 38 relative to the position of the thermistor 28 and no need to change the length of the first cable 31 relative to the position of the thermistor 28, but the connector holding portion 38 and the first cable 31 can be used as common parts as other parts included in the printer 11.

Furthermore, the printer 11 configured as above includes the fuser assembly 16 with good maintainability, therefore also offering good maintainability.

The wall section 39 includes a pair of projecting parts 42*a*, 42*b* that project so as to form a cutout 41 therebetween. The cutout 41 facilitates attachment of the connector 34 with the terminal 33 connected thereto into the connector holding portion 38, and consequently the printer 11 can offer better maintainability.

Although, in the above-described embodiment, the wall section 39 is configured to include a pair of projecting parts 42*a*, 42*b* both projecting so as to form a cutout 41 therebetween, the present disclosure is not limited thereto, and the wall section 39 may include a flat part and a projecting part projecting toward the flat part to form the cutout 41.

It should be understood that the embodiment disclosed herein is illustrative and non-restrictive in every respect. The scope of the present disclosure is defined by the terms of the claims, rather than by the foregoing description, and is intended to include any modifications within the scope and meaning equivalent to the terms of the claims.

The connector attaching/detaching structure, fuser assembly, and image forming apparatus according to the disclosure can be effectively used especially to meet a demand for good maintainability.

What is claimed is:

1. A connector attaching/detaching structure for detachably holding a connector in a housing, comprising:

a first cable;

a second cable;

a terminal that is provided on an end of the first cable;

a connector that is provided on an end of the second cable and is capable of establishing an electrical connection with the terminal by inserting the terminal into the connector; and a housing that includes a connector holding portion that detachably holds the connector, wherein a wall section, which forms an outer part of the connector holding portion, has a cutout wide enough to permit the first cable to pass therethrough, and the connector is held in the connector holding portion by mounting the connector on the connector holding portion after connecting the terminal and the connector, and drawing the first cable through the cutout.

2. The connector attaching/detaching structure according to claim 1, wherein the wall section includes a pair of projecting parts that project to each other to form the cutout therebetween.

3. The connector attaching/detaching structure according to claim 2, wherein a space is surrounded by a bottom wall which is a part of the wall sections, and the pair of projecting parts so as to accommodate the connector, and the space has a height from the bottom wall that is approximately the same as that of the connector.

4. The connector attaching/detaching structure according to claim 1, wherein the housing has recessed portions that recess inwardly, and the cables can be accommodated in the recessed portions.

5. The connector attaching/detaching structure according to claim 1, wherein the housing is made of resin.

6. The connector attaching/detaching structure according to claim 1, wherein the connector holding portion is formed by cutting away part of the housing.

7. The connector attaching/detaching structure according to claim 1, wherein the connector has a pair of elastically-deformable snap parts, and the connector is held in the connector holding portion by snap fitting.

8. A fuser assembly that fuses toner on paper comprising:

a pressure roller;

a heat roller that is disposed in contact with the pressure roller;

a thermistor that is disposed to face a surface of the heat roller and senses the temperature of the heat roller;

a first cable that is connected to the thermistor;

a second cable that is connected to a control unit that controls the fuser assembly;

a terminal that is provided on an end of the first cable;

a connector that is provided on an end of the second cable and is capable of establishing an electrical connection with the terminal by inserting the terminal into the connector; and a housing that includes a connector holding portion detachably holding the connector and accommodates the heat roller and the pressure roller, wherein a wall section, which forms an outer part of the connector holding portion, has a cutout wide enough to permit the first cable to pass therethrough, and the connector is held in the connector holding portion by mounting the connector on the connector holding portion after connecting the terminal and the connector, and drawing the first cable through the cutout.

9. An image forming apparatus comprising a fuser assembly that fuses a visible toner image on paper and an image forming unit that forms the visible toner image on the paper, wherein the fuser assembly includes:

a pressure roller;

a heat roller that is disposed in contact with the pressure roller;

a thermistor that is disposed to face a surface of the heat roller and senses the temperature of the heat roller;

a first cable that is connected to the thermistor;

a second cable that is connected to a control unit that controls the fuser assembly;

a terminal that is provided on an end of the first cable;

a connector that is provided on an end of the second cable and is capable of establishing an electrical connection with the terminal by inserting the terminal into the connector; and a housing that includes a connector holding portion detachably holding the connector and accommodates the heat roller and the pressure roller, wherein a wall section, which forms an outer part of the connector holding portion, has a cutout wide enough to permit the first cable to pass therethrough, and the connector is held in the connector holding portion by mounting the connector on the connector holding portion after connecting the terminal and the connector, and drawing the first cable through the cutout.

* * * * *